US005536001A

United States Patent [19]

Lange et al.

[11] Patent Number: 5,536,001

[45] Date of Patent: Jul. 16, 1996

[54] APPARATUS FOR TRANSPORTING AND DECELERATING FOLDED PRODUCTS

[75] Inventors: Klaus-Ulrich Lange, Gersthofen; Dieter Zacherl, Obergriesbach, both of Germany

[73] Assignee: MAN Roland Druckmaschinen AG, Offenbach am Main, Germany

[21] Appl. No.: 431,125

[22] Filed: Apr. 28, 1995

Related U.S. Application Data

[63] Continuation of Ser. No. 168,636, Dec. 16, 1993, abandoned.

[30] Foreign Application Priority Data

Dec. 19, 1992 [DE] Germany ..... 42 43 222.7

[51] Int. Cl.[6] ..... B65H 29/66

[52] U.S. Cl. ..... 271/202; 198/626.1; 198/462.3

[58] Field of Search ..... 271/202, 182, 271/270; 198/462, 626.1, 626.5, 604, 605

[56] References Cited

U.S. PATENT DOCUMENTS

| | | | |
|---|---|---|---|
| 2,819,079 | 1/1958 | Beaulieu | 271/202 |
| 2,820,633 | 1/1958 | Caulfield | 271/202 |
| 4,516,759 | 5/1985 | Kobler | 271/182 X |
| 4,913,415 | 4/1990 | Weber | 271/202 X |
| 5,039,082 | 8/1991 | Littleton | 271/202 X |
| 5,265,862 | 11/1993 | Jones et al. | 271/182 |

FOREIGN PATENT DOCUMENTS

| | | | |
|---|---|---|---|
| 9108969 | 6/1991 | WIPO | 198/604 |

*Primary Examiner*—William E. Terrell
*Assistant Examiner*—Tamara Kelly
*Attorney, Agent, or Firm*—Cohen, Pontani, Lieberman, Pavane

[57] ABSTRACT

An apparatus for transporting and a dependable deceleration of folded products, e.g. before being fed to a second longitudinal fold, including two groups of belts, each of which contains upper and lower belts, supplemented by a further belt group containing only upper belts. These belts of the further belt group are guided parallel to the lower belts of the first belt group at a distance which is greater than the product thickness.

10 Claims, 3 Drawing Sheets

APPARATUS FOR TRANSPORTING AND DECELERATING FOLDED PRODUCTS

This is a continuation, of application Ser. No. 08/168,636, filed Dec. 16, 1993, now abandoned.

BACKGROUND OF THE INVENTION

1. Field of the Invention

The invention is directed to an apparatus for transporting and for decelerating folded products between two consecutive stations of a folding apparatus in a web-fed rotary printing machine. In particular, between a folding cylinder and a longitudinal folding device or a feeder station. The transporting and decelerating take place by two belt groups arranged in tandem, each group containing upper and lower belts between which the products are guided. The second belt group, with reference to the transporting direction, forms a feed gap between the upper belts and lower belts and moves slower than the first belt group.

2. Brief Description of the Prior Art

It is known from the general prior art to decelerate folded products in a folding apparatus, e.g. on route from the folding cylinder to the second longitudinal folding device, by means of two groups of belts. The belt groups are arranged in tandem, each group containing upper and lower belts between which the products are guided. The second belt group can be driven at a lower speed via a toothed wheel gear unit. The first belt group has a wedge-shaped outlet and the second belt group has a wedge-shaped intake or feed gap. With products of varying thickness, these wedges cause the product to be clamped along areas of different length by the fast-moving first belt group and by the slower second belt group. This results in the formation of waves in the product. Further, there is a gap between the upper belts of the first and second belt groups toward which the beginning and end of the sheet tend to move. In spite of covering this gap with tabs, there is a risk of paper jams and bent corners of the product.

SUMMARY OF THE INVENTION

Accordingly, it is an object of the present invention is to guide the products in a reliable manner in an apparatus of the generic type regardless of paper thickness and quality.

Pursuant to this object, and others which will become apparent hereafter, one aspect of the present invention resides in an apparatus for transporting and decelerating folded products of the above-mentioned type in which a third belt group containing only upper belts is arranged between the upper belts of the first and second belt group, parallel to the lower belts of the first belt group and at a distance from the first belt group which is greater than the product thickness. The third belt group has deflecting rollers that are arranged in the straight-line guidance regions of the upper belts of the first and second belt group. The first belt system no longer has a wedge-shaped outlet so that when products of different thickness are transferred into the slow-moving second belt group the clamping length varies only slightly. Further, the third belt group and the lower belts of the first belt group together form a kind of chamber which, when passed by the product, causes the product to be gently smoothed or flattened toward the end of the product due to the lagging behind of the belts of the third belt group so as to prevent the formation of waves. Finally, the upper belts of the three belt groups adjoin one another without gaps, thus eliminating a source of problems for jams.

In a further embodiment of the invention the deflecting rollers of the third belt group are supported so as to be freely rotatable on the shafts of the adjacent deflecting cylinders of the upper belts of the first and second belt groups. Additionally, the deflecting rollers arranged on the deflecting cylinder of the first belt group have a smaller diameter than the deflecting cylinder.

In still a further embodiment, the third belt group is driven at a slower speed than the first belt group.

Another embodiment provides that the second belt group is driven by a gear unit with a continuously adjustable gear ratio.

In yet another embodiment of the invention, a cylinder is arranged between the adjacent deflecting cylinders of the upper belts of the first and second belt groups. The cylinder is adjustable relative to the lower belts over the first belt group and has grooves in its outer surface area in a region of the upper belts of the third belt group.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
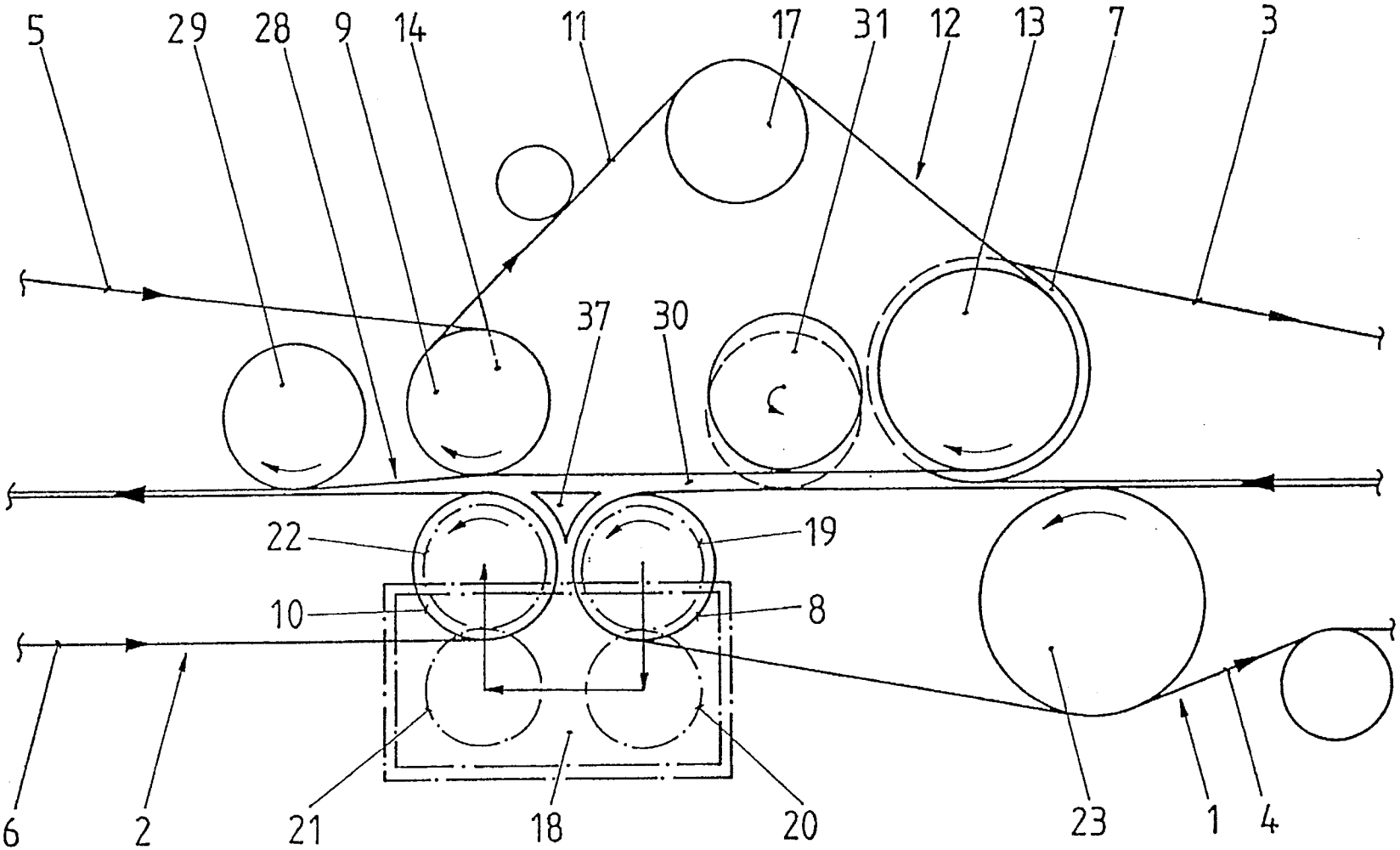
FIG. 1 is a side view of a transporting and decelerating apparatus pursuant to the present invention.
Figure 2:
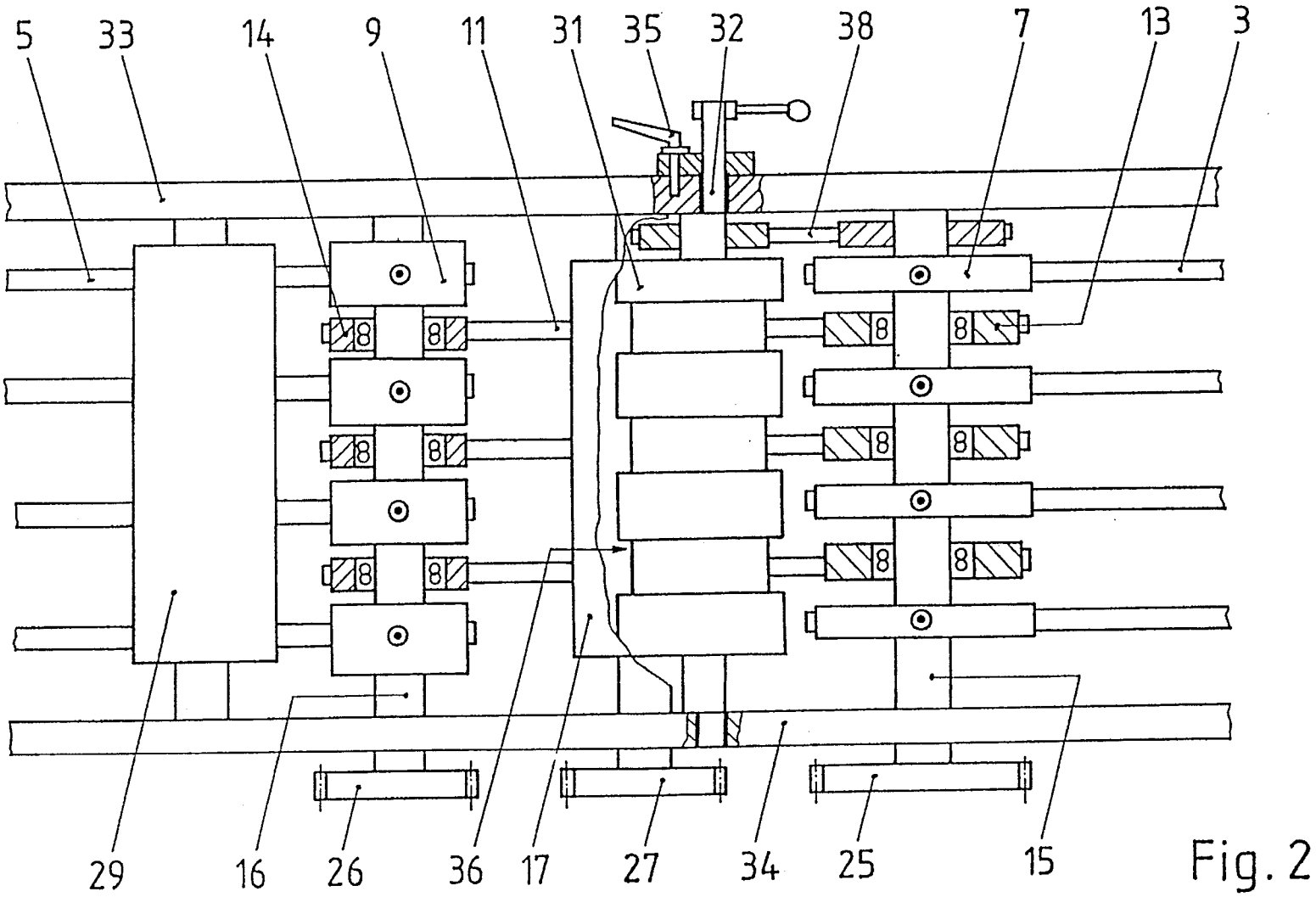
FIG. 2 is a top view of the upper belts of the apparatus, partially in section.
Figure 3:
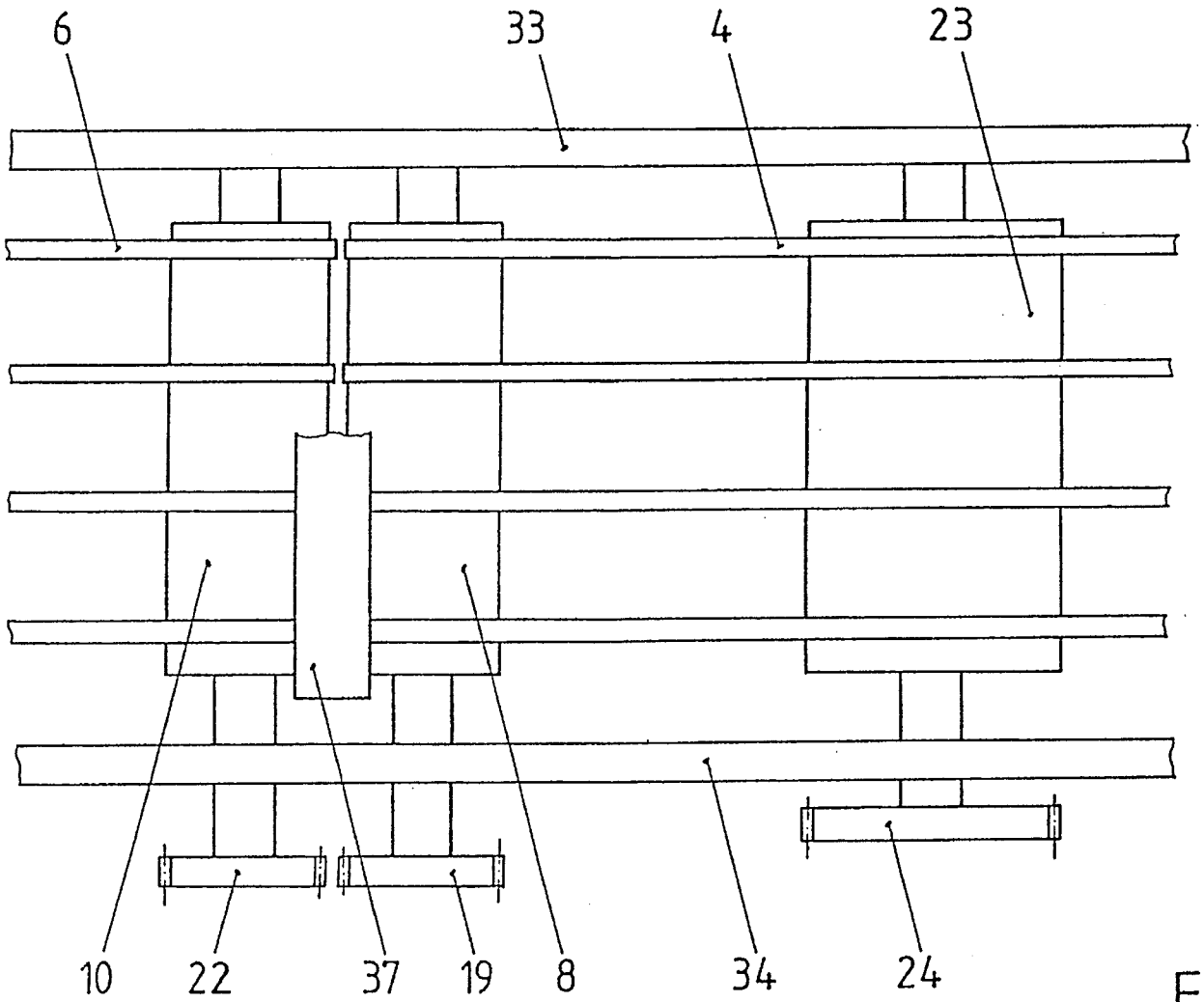
FIG. 3 is a top view of the lower belts of the apparatus.

The transporting and decelerating apparatus contains a first belt group 1 and a second belt group 2 which are arranged one after the other in the transporting direction of the products. Each group contains upper and lower belts 3 to 6. The latter are arranged adjacent to one another at a distance (FIGS. 2 and 3) and are guided via driven deflecting cylinders 7 to 10. A third belt group 12 containing only upper belts 11 is arranged between the upper belts 3, 5 of the first and second belt groups 1, 2. These upper belts 11 lie parallel to the lower belts 4 of the first belt group 1 at a distance corresponding to the product thickness plus approximately 3 to 4 mm. To prevent gaps relative to the upper belts 3 and 5, the deflecting rollers 13, 14 of the upper belts 11 are supported on the shafts 15, 16 of the deflecting cylinders 7, 9. Further, the upper belts 11 are guided via a deflecting cylinder 17 by which they are driven at a speed of roughly 96% of the speed of the belts of the first belt group 1. Due to this difference in speed, the deflecting rollers 13, 14 are supported so as to be freely rotatable on the shafts 15, 16. To achieve the distance from the upper belts 11 to the lower belts 4, the diameter of the deflecting roller 13 is smaller than that of the deflecting cylinder 7.

The second belt group 2 is driven via a gear unit 18 with a continuously adjustable gear ratio. In the embodiment illustrated, a toothed wheel 19 of the deflecting cylinder 8 moves on a driving toothed wheel 20 of the gear unit 18 and its driven toothed wheel 21 moves on a toothed wheel 22 of the deflecting cylinder 10 for the lower belts 6 of the second belt group 2. The driving of belts is otherwise familiar to the person skilled in the art. Therefore, only the toothed wheel 24 in the belt cylinder 23 and only toothed wheels 25, 26 and 27 in the deflecting cylinders 7, 9 and 17, respectively, are shown in the drawing. A guide plate 37 is arranged in the gap between the deflecting cylinders 8, 10.

The folded product, not shown, arriving from a folding cylinder, for example, is transported in the direction of the arrow between the upper belts 3 and the lower belts 4 at a speed v=100%. Shortly before the product leaves the clamping region of these belts, i.e. shortly before the end of the product exits the region of the deflecting cylinder, the beginning of the product is grasped in the vicinity of the apex of the feed gap 28 which is formed between a belt cylinder 29 and the deflecting cylinder 9 of the upper belts 5 and the lower belts 6. The speed of these belts 5, 6 is continuously adjustable by means of the gear unit 18 between v=100% and v=60% of the speed of the upper and lower belts 3, 4. The folded product is decelerated to the speed adjusted as a function of the type of paper and is transported further at this speed. In so doing, the folded product inflates slightly when passing the chamber 30 formed by the upper belts 11 and lower belts 4, gently contacts the upper belts 11, and is gently smoothed or flattened toward the end of the sheet since these upper belts 11 revolve at a speed of v=roughly 96% of the speed of the upper and lower belts 3, 4.

A cylinder 31 which can be adjusted relative to the lower belts 4 is located downstream of the deflecting cylinder 7 in the transporting direction of the folded products. In the embodiment shown, this adjustment is effected by means of an eccentric, that is, the cylinder 31 has eccentric pins 32 by which it is supported in the frame walls 33, 34. The cylinder 31 is adjusted toward or away from the lower belts 4 by turning its pin 32 and then locking this pin 32 by means of a clamping device 35. The cylinder 31 serves to process shorter products, e.g. delta fold products. When adjusted toward the lower belts 4 (shown in dashed lines), the cylinder 31 takes over the clamping of the folded products until they are grasped in the feed gap 28. The cylinder 31 is driven by the deflecting cylinder 7 via a belt drive 38. There are grooves 36 in the region of the cylinder 31 to prevent it from colliding with the upper belts 11 when adjusted toward the lower belts 4.

In the embodiment shown, the deflecting rollers of the upper belts of the third belt groups are supported on the adjacent deflecting cylinders 7, 9 of the upper belts 3,5 of the first belt group 1 and second belt group 2. Within the protective scope of the patent, these deflecting rollers can also be supported on separate shafts arranged in the straight-line guidance region of the upper belts of the first and second belt groups, i.e. deeper in these belt groups.

The invention is not limited by the embodiments described above which are presented as examples only but can be modified in various ways within the scope of protection defined by the appended patent claims.

We claim:

1. An apparatus for transporting and decelerating folded products between two consecutive stations of a folding apparatus in a web-fed rotary printing machine, comprising: a first belt group and a second belt group arranged in tandem, each group containing upper belts and lower belts which the products are guided, the upper belts having regions which guide the products in a straight line, the second belt group, with reference to a transporting direction, forms a feed gap between the upper belts and the lower belts and moves slower than the first belt group; and a third belt group containing only upper belts and arranged between the upper belts of the first and second belt groups, parallel to the lower belts of the first belt group and at a distance from the lower belts of the first belt group which is greater than a thickness of the products so that a parallel-sided chamber is defined between the lower belts of the first belt group and the belts of the third belt group, and extends substantially the length of the third belt group and so that the feed gap of the second belt group is downstream of the chamber in the transporting direction, the third belt group having deflecting rollers that are arranged in the straight-line guide regions of the upper belts of the first and the second belt groups, the first and third belt groups being operative to push a folded product through the chamber and into the feed gap.

2. An apparatus according to claim 1, wherein the first and the second belt groups each have a deflecting cylinder for the upper belts, the deflecting cylinders being arranged on shafts, the deflecting rollers of the third belt group being supported so as to be freely rotatable on the shafts of the adjacent deflecting cylinders of the upper belts of the first and the second belt groups, the deflecting rollers of the third belt group arranged on the deflecting cylinder of the first belt group having a diameter smaller than that of the deflecting cylinder of the first belt group.

3. An apparatus according to claim 1, and further comprising gear means for driving the second belt group, the gear means having a continuously adjustable gear ratio.

4. An apparatus according to claim 2, and further comprising a further cylinder arranged between the deflecting cylinder of the upper belt of the first belt group and the deflecting cylinder of the upper belt of the second belt group, the further cylinder being adjustable relative to the lower belts of the first belt group and having an outer surface area with grooves in a region of the upper belts of the third belt group.

5. An apparatus according to claim 4, and further comprising means for adjusting the further cylinder relative to the lower belts of the first belt group.

6. An apparatus according to claim 5, and further comprising a frame, the adjusting means including an eccentric pin which mounts the further cylinder to the frame so as to permit the further cylinder to move relative to the lower belts of the first belt group by rotation of the eccentric pin, the adjusting means further including a clamping device for locking the eccentric pin.

7. An apparatus according to claim 4, wherein the further cylinder is driven via belt by the deflecting cylinder of the upper belts of the first belt group.

8. An apparatus according to claim 3, wherein the belts of the second belt group are driven by the gear means to have a speed between 60% and 100% of the speed of the belts of the first belt group.

9. An apparatus according to claim 1, wherein the third belt group is driven at a speed of 96% of the speed of the first belt group.

10. An apparatus according to claim 1, wherein the third belt group is driven at a slower speed than the first belt group.

* * * * *